US007654867B2

(12) United States Patent
Tai et al.

(10) Patent No.: US 7,654,867 B2
(45) Date of Patent: Feb. 2, 2010

(54) RECEPTACLE CONNECTOR ASSEMBLY FOR IC CARD AND IC CARD CONNECTOR

(75) Inventors: Kenny Tai, Taoyuan Hsien (CN); Maslow Lin, Taoyuan Hsien (CN); Scott Lu, Taoyuan Hsien (CN)

(73) Assignee: FCI, Versailles (FR)

( * ) Notice: Subject to any disclaimer, the term of this patent is extended or adjusted under 35 U.S.C. 154(b) by 752 days.

(21) Appl. No.: 10/560,194

(22) PCT Filed: Jun. 10, 2004 (Under 37 CFR 1.47)

(86) PCT No.: PCT/SG2004/000176

§ 371 (c)(1), (2), (4) Date: Apr. 11, 2006

(87) PCT Pub. No.: WO2004/109867

PCT Pub. Date: Dec. 16, 2004

(65) Prior Publication Data

US 2009/0137151 A1 May 28, 2009

(30) Foreign Application Priority Data

Jun. 11, 2003 (TW) ..... 92115838 A

(51) Int. Cl.
*H01R 13/648* (2006.01)

(52) U.S. Cl. ..... 439/607.22; 439/76.1

(58) Field of Classification Search . 439/607.2–607.27, 439/607.31–607.4, 108, 495, 579; 361/737
See application file for complete search history.

(56) References Cited

U.S. PATENT DOCUMENTS 4,365,856 A * 12/1982 Yaegashi et al. ..... 439/497
4,653,825 A * 3/1987 Olsson ..... 439/295
5,871,369 A * 2/1999 Obayashi et al. ..... 439/495
5,896,274 A 4/1999 Ishida ..... 361/737
6,123,582 A * 9/2000 Ko et al. ..... 439/579
6,165,008 A * 12/2000 Wu et al. ..... 439/492
6,273,753 B1 * 8/2001 Ko ..... 439/579
6,305,978 B1 * 10/2001 Ko et al. ..... 439/579
6,648,668 B1 * 11/2003 Ko ..... 439/353
6,717,818 B1 * 4/2004 Lin ..... 361/753
6,805,585 B1 * 10/2004 Ko ..... 439/607.01
6,902,425 B2 * 6/2005 Huang ..... 439/495
6,932,626 B2 * 8/2005 Costello et al. ..... 439/108
2003/0199197 A1 * 10/2003 Yu et al. ..... 439/607
2006/0134969 A1 * 6/2006 Takaku et al. ..... 439/495
2007/0054552 A1 * 3/2007 Liang ..... 439/607

FOREIGN PATENT DOCUMENTS

EP 0 834 964 A1 4/1998

* cited by examiner

*Primary Examiner*—T C Patel
*Assistant Examiner*—Harshad C Patel
(74) *Attorney, Agent, or Firm*—Harrington & Smith, PC

(57) ABSTRACT

Disclosed is a receptacle connector assembly for an IC card, comprising: a connector housing (20) having a top surface (21), a bottom surface (22), and a peripheral wall (23) located between the top surface and bottom surface; a plurality of terminals (30) mounted in the connector housing and extending from the peripheral wall; a shielding member (40) removably attached to the top surface of the connector housing and having a portion extending over the terminals; and a supporting member (50) removably attached to the connector housing and covering the portion of the shielding member extending over the terminals.

16 Claims, 3 Drawing Sheets

RECEPTACLE CONNECTOR ASSEMBLY FOR IC CARD AND IC CARD CONNECTOR

CROSS-REFERENCES TO RELATED APPLICATIONS

Not Applicable

STATEMENT REGARDING FEDERALLY SPONSORED RESEARCH OR DEVELOPMENT

Not Applicable

FIELD OF INVENTION

The invention relates to a receptacle connector assembly for an IC card, particularly to one meeting the insulation specifications prescribed in the PCMCIA protocols.

BACKGROUND

In the conventional receptacle assemblies for an IC card, such as those disclosed in U.S. Pat. Nos. 5,807,137 and 5,896,274, and JP11-260488, adhesive is employed to secure a shielding member for shielding noises to a header housing of the receptacle connector assembly, where the shielding member covers a portion of terminals; a metal shield of the IC card then covers a portion of the shielding member.

Though such a design helps the connector shield from noises, the shielding member may not be properly insulated from the metal shield.

In addition, the lacking of protective measure between the shielding member and the terminals results in easy penetration of dust through the gap formed between the shielding member and metal shield and into the header housing or terminals, thereby causing short circuits.

Furthermore, it is relatively inconvenient to remove the shielding member from the header housing in case components are damaged during assembly.

SUMMARY OF INVENTION

It is a primary objective of this invention to provide a receptacle connector assembly that meets the specifications provided in Vol. 3, Section 4.1 of the PCMCIA protocols.

It is a further objective of this invention to provide an IC card connector having such a receptacle connector assembly.

It is another objective of this invention to provide an IC card connector allowing easy replacement of the shielding member.

It is yet another objective of this invention to provide a receptacle connector assembly capable of preventing dust from tainting the terminals.

To achieve the above objectives, this invention discloses a receptacle connector assembly, including: a connector housing having a top surface, a bottom surface, and a peripheral wall located between the top surface and bottom surface; a plurality of terminals mounted in the connector housing and extending from the peripheral wall; a shielding member removably attached to the top surface of the connector housing and having a portion extending over the terminals; and a supporting member removably attached to the connector housing and covering the portion of the shielding member extending over the terminals.

This invention further discloses an IC card connector having such a receptacle connector assembly.

BRIEF DESCRIPTION OF THE DRAWINGS

These and other modifications and advantages will become even more apparent from the following detailed description of a preferred embodiment of the invention and from the drawings in which.

DETAILED DESCRIPTION OF THE INVENTION

Preferred Embodiments

Figure 1:
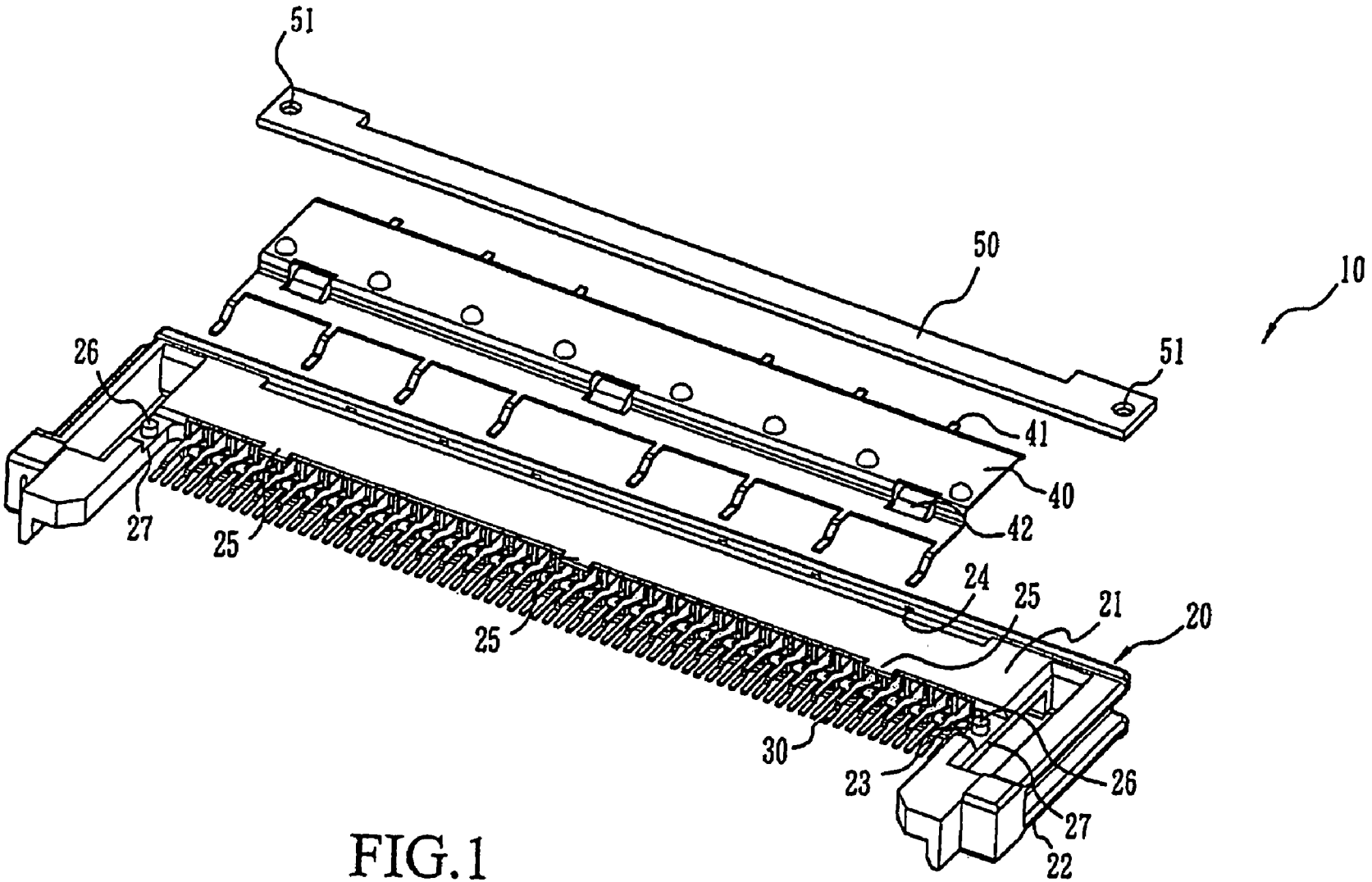
FIG. 1 illustrates an exploded, perspective view of a receptacle connector assembly for an IC card of this invention.

FIG. 1 illustrates an exploded, perspective view of a receptacle connector assembly 10 for an IC card of this invention.

The receptacle connector assembly 10 for an IC card includes: a header housing 20, a plurality of terminals 30, a shielding member 40, and a supporting member 50.

The header housing 20 includes a top surface 21, a bottom surface 22, and a peripheral wall 23 located between the top surface 21 and bottom surface 22.

The plurality of terminals 30 are mounted in the housing 20 and extend from the peripheral wall 23.

Figure 2:
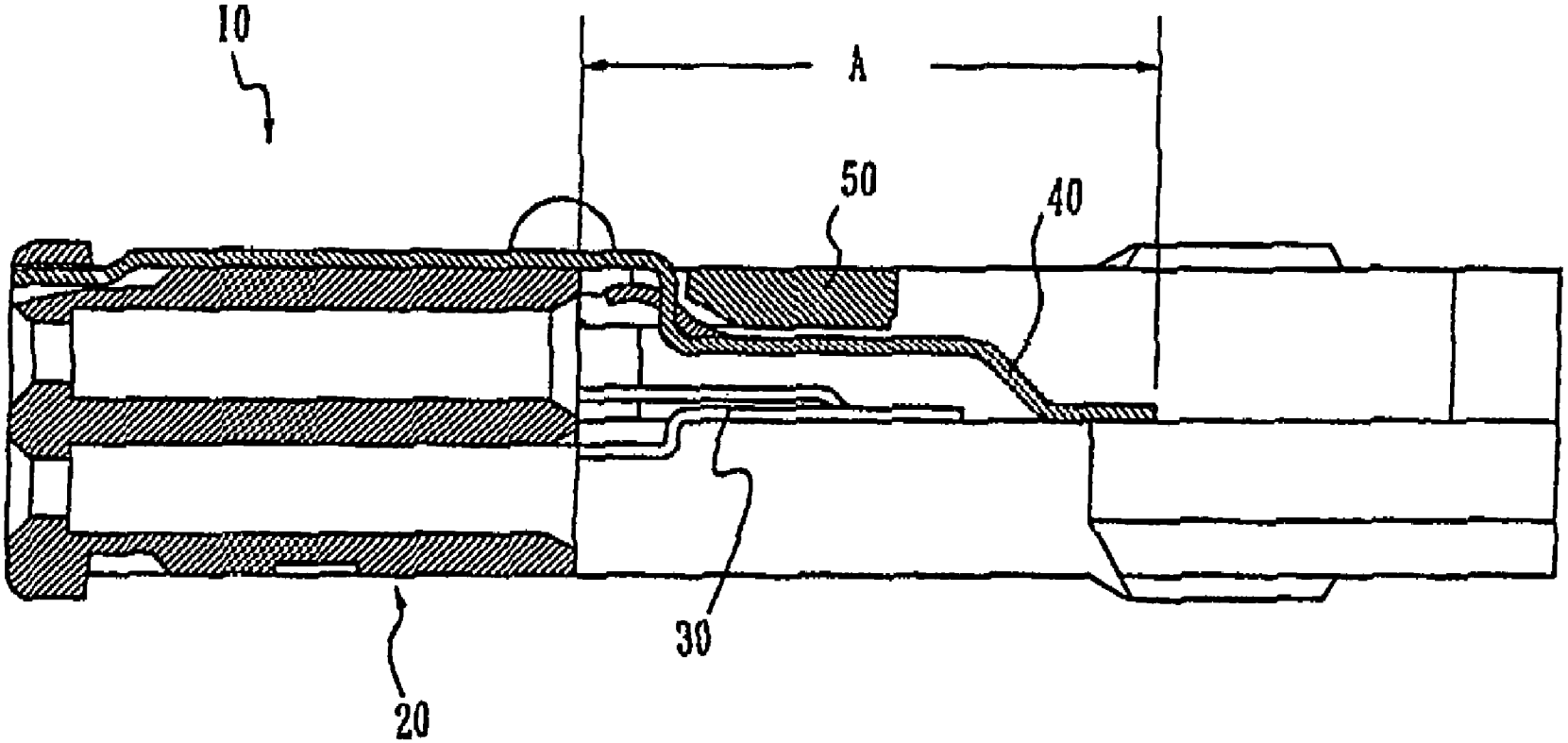
FIG. 2 is a side cross-sectional view of the receptacle connector assembly for an IC card in FIG. 1.

The shielding member 40 includes a plurality of positioning pins 41, and the housing 20 is formed with a plurality of openings 24 at locations corresponding to the positioning pins 41 for insertion of the positioning pins 41. As such, the shielding member 40 may be attached to the top surface 21 of the housing 20 to allow a portion A thereof extending over the terminals 30, as shown in FIG. 2.

The receptacle assembly 10 may include a locking mechanism for removably locking the shielding member 40 to the housing 20.

According to a preferred embodiment of this invention, the locking mechanism includes: a plurality of resilient tabs 42 formed on the shielding member 40; and a plurality of protrusions 25 formed on the housing 20 at locations corresponding to the resilient tabs 42. As such, the protrusions 25 may be inserted under the resilient tabs 42 so as to removably lock the shielding member 40 to the housing 20.

The shielding member 40 is preferably made of brass sheets by stamping.

The supporting member 50 is removably attached to the housing 20 and covers the portion A of the shielding member 40 extending over the terminals 30. The receptacle connector assembly 10 includes a mounting mechanism for removably mounting the supporting member 50 to the housing 20.

According to a preferred embodiment of this invention, the mounting mechanism includes: a pair of posts 26 symmetrically arranged on the top surface 21 at two opposing ends of the housing 20; and a pair of holes 51 formed on the supporting member 50 at locations corresponding to the posts 26 for insertion of the posts 26. The tops of the posts 26 may be pressed and deformed by a jig to serve as rivets for securing the supporting member 50 on the housing 20 when necessary.

According to another embodiment of this invention as shown, the mounting mechanism may include: a recess 27 formed at each of two opposing ends of the top surface 21 of the housing 20 for press-fitting with the opposing ends of the supporting member 50. The recesses 27 and posts 26-holes 51 may be adopted selectively or simultaneously as required to ensure secured attachment result.

Figure 3:
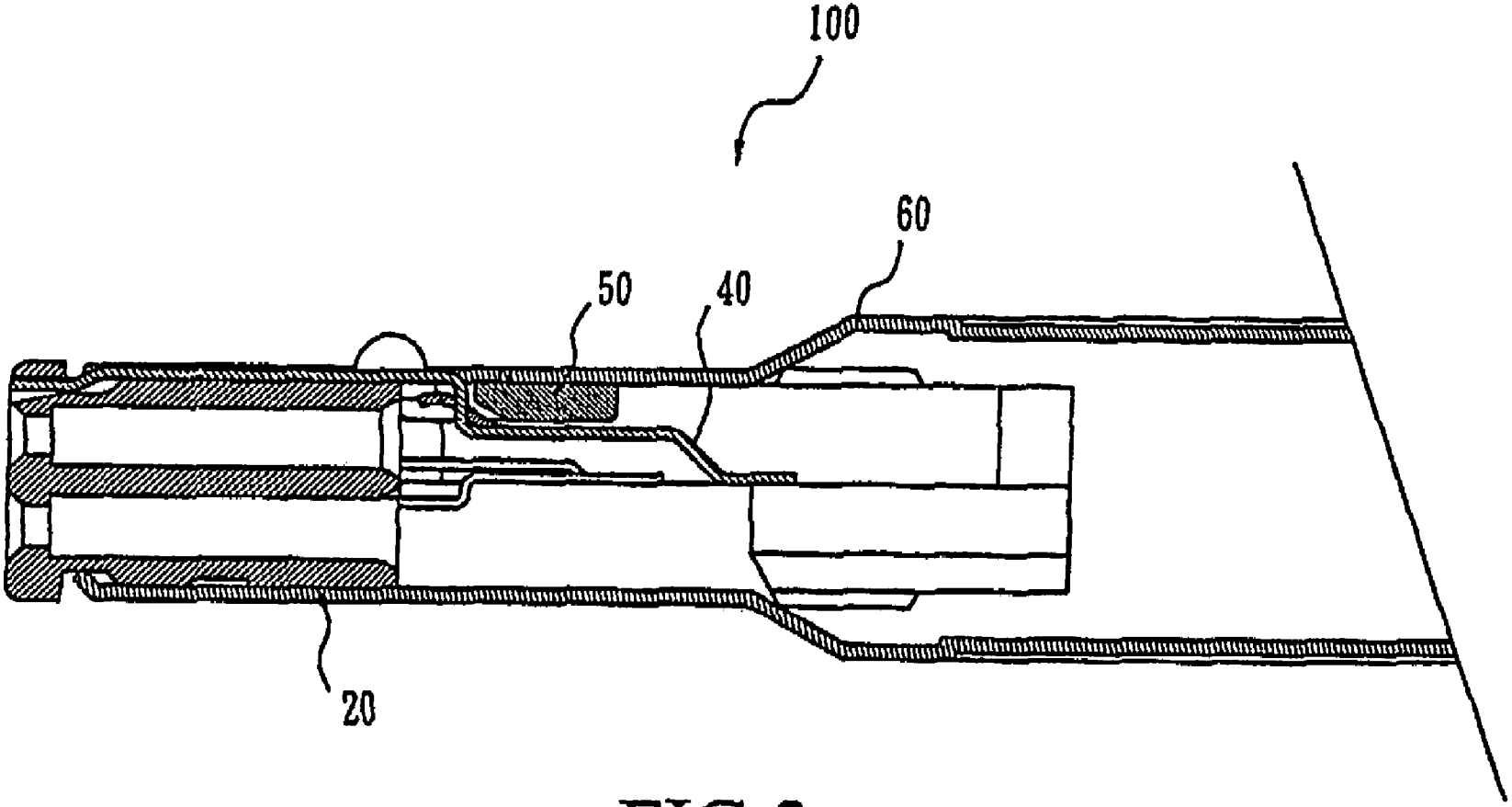
FIG. 3 is a cross-sectional view illustrating an IC card connector assembled from the receptacle connector assembly as shown in FIGS. 1 and 2.

To assemble the header housing 20 into an IC card connector 100, as shown in FIG. 3, a metal shield 60 covering an IC card substrate is mounted over an outer side of a portion of the top surface 21 of the header housing 20. The portion A of the shielding member 40 that extends over the terminals 30 is extended between a portion between the metal shield 60 and the terminals 30. The supporting member 50 then extends between the metal shield 60 and the shielding member 40.

To ensure that the assembled IC card connector 100 can meet the specifications provided in Vol. 3, Section 4.1 of the PCMCIA protocols, the supporting member 50 provided between the metal shield 60 and shielding member 40 is preferably made of an insulating material, such as plastics or Liquid Crystal Polymer (LCP) by injection molding.

Because the shielding member 40 and supporting member 50 in this invention can be mounted to the header housing 20 in a removable manner, the shielding member 40 and supporting member 50 may be easily removed and replaced with new components when such components are damaged during assembly.

In addition, the supporting member 50 can also prevent penetration of dust into the gap formed between the shielding member 40 and metal shield 60 thereby eliminating the occurrence of short circuits.

This invention is related to a novel creation that makes a breakthrough in the art. Aforementioned explanations, however, are directed to the description of preferred embodiments according to this invention. Since this invention is not limited to the specific details described in connection with the preferred embodiments, changes and implementations to certain features of the preferred embodiments without altering the overall basic function of the invention are contemplated within the scope of the appended claims.

LISTING OF NOMENCLATURES

A portion
10 receptacle assembly for IC card
20 header housing
21 top surface
22 bottom surface
23 peripheral wall
24 openings
25 protrusions
26 posts
27 recess
30 terminals
40 shielding member
41 positioning pins
42 resilient tabs
50 supporting member
51 holes
60 metal shield
100 IC card connector

What is claimed is:

1. A receptacle connector assembly, comprising;

a connector housing having a top surface, a bottom surface, and a peripheral wall located between the top surface and bottom surface;

a plurality of terminals mounted in the connector housing and extending from the peripheral wall;

a shielding member removably attached to the top surface of the connector housing and having a portion extending over the terminals;

a supporting member removably attached to the connector housing and covering the portion of the shielding member extending over the terminals, and a mounting mechanism for removably mounting the supporting member to the connector housing, wherein the mounting mechanism comprises a recess formed at each of two opposing ends of the connector housing for press-fitting opposing ends of the supporting member.

2. The receptacle connector assembly according to claim 1, wherein the shielding member includes a plurality of positioning pins, and the connector housing is formed with a plurality of openings at locations corresponding to the positioning pins for insertion of the positioning pins.

3. The receptacle connector assembly according to claim 2, further comprising a locking mechanism for removably locking the shielding member to the connector housing.

4. The receptacle connector assembly according to claim 3, wherein the locking mechanism comprises:

a plurality of resilient tabs formed on the shielding member, and a plurality of protrusions formed on the connector housing at locations corresponding to the resilient tabs to be removably locked to the protrusions.

5. The receptacle connector assembly according to claim 1, wherein the mounting mechanism comprises:

a pair of posts symmetrically arranged on the top surface at two opposing ends of the connector housing; and a pair of holes formed on the supporting member at locations corresponding to the posts for insertion of the posts.

6. The receptacle connector assembly according to claim 5, wherein the posts serve as rivets to secure the supporting member on the connector housing.

7. The receptacle connector assembly according to claim 1, wherein the supporting member is made of an insulating material.

8. The receptacle connector assembly according to claim 7, wherein the supporting member is made of plastics.

9. An IC card connector, comprising:

a header having a top surface, a bottom surface, and a peripheral wall located between the top surface and bottom surface;

a metal shield mounted over a portion of the top surface of the header;

a plurality of terminals mounted in the header and extending from the peripheral wall;

a shielding member removably attached to the top surface of the header and having a portion extending between the shield and the terminals;

a supporting member removably attached to the header and extending between the metal shield and the shielding member, and a mounting mechanism for removably mounting the supporting member to the header, wherein the mounting mechanism corn rises a recess formed at two opposing ends of the header for press-fitting opposing ends of the supporting member.

10. The IC card connector according to claim 9, wherein the shielding member includes a plurality of positioning pins, and wherein the header is formed with a plurality of openings at locations corresponding to the positioning pins for insertion of the positioning pins.

11. The IC card connector according to claim 10, further comprising a locking mechanism for removably locking the shielding member to the header.

12. The IC card connector according to claim 11, wherein the locking mechanism comprises:

a plurality of resilient tabs formed on the shielding member; and a plurality of protrusions formed on the header at locations corresponding to the resilient tabs to be removably locked to the protrusions.

13. The IC card connector according to claim 9, wherein the mounting mechanism comprises:

a pair of posts symmetrically arranged on the top surface at two opposing ends of the header; and a pair of holes formed on the supporting member at locations corresponding to the posts for insertion of the posts.

14. The IC card connector according to claim 13, wherein the posts serve as rivets to secure the supporting member on the header.

15. The IC card connector according to claim 9, wherein the supporting member is made of any insulating materials.

16. The IC card connector according to claim 15, wherein the supporting member is made of plastics.

* * * * *

UNITED STATES PATENT AND TRADEMARK OFFICE

CERTIFICATE OF CORRECTION

PATENT NO. : 7,654,867 B2
APPLICATION NO. : 10/560194
DATED : February 2, 2010
INVENTOR(S) : Tai et al.

It is certified that error appears in the above-identified patent and that said Letters Patent is hereby corrected as shown below:

Claim 9, col. 4, line 53 delete "corn rises" and insert --comprises--.

Signed and Sealed this

Thirtieth Day of March, 2010

David J. Kappos

David J. Kappos
*Director of the United States Patent and Trademark Office*